US009399362B1

(12) United States Patent
Cobb, III

(10) Patent No.: US 9,399,362 B1
(45) Date of Patent: Jul. 26, 2016

(54) METHOD OF SELECTIVELY TRANSFERRING AN IMAGE AND HEAT-TRANSFER ASSEMBLY

(71) Applicant: Vivid Chemical, LLC, Mt. Pleasant, SC (US)

(72) Inventor: James D Cobb, III, Isle of Palms, SC (US)

(73) Assignee: Vivid Transfers, LLC, Mt. Pleasant, SC (US)

( * ) Notice: Subject to any disclaimer, the term of this patent is extended or adjusted under 35 U.S.C. 154(b) by 0 days.

(21) Appl. No.: 14/674,032

(22) Filed: Mar. 31, 2015

(51) Int. Cl.
*B44C 1/17* (2006.01)
*B41M 3/12* (2006.01)

(52) U.S. Cl.
CPC ..... *B41M 3/12* (2013.01); *B44C 1/1729* (2013.01)

(58) Field of Classification Search
None
See application file for complete search history.

(56) References Cited

U.S. PATENT DOCUMENTS

| | | | |
|---|---|---|---|
| 3,907,974 | A | 9/1975 | Smith |
| 4,021,591 | A | 5/1977 | DeVries et al. |
| 4,058,644 | A | 11/1977 | DeVries et al. |
| 4,171,202 | A | 10/1979 | Sideman et al. |
| 4,515,849 | A | 5/1985 | Keino et al. |
| 4,576,610 | A | 3/1986 | Donenfeld |
| 4,619,665 | A | 10/1986 | Sideman et al. |
| 5,134,112 | A | 7/1992 | Kanto et al. |
| 6,050,193 | A | 4/2000 | DeBoer et al. |
| 6,080,261 | A | 6/2000 | Popat et al. |
| 6,103,041 | A | 8/2000 | Wagner et al. |
| 6,105,502 | A | 8/2000 | Wagner et al. |
| 6,124,417 | A | 9/2000 | Su |
| 6,450,633 | B1 | 9/2002 | Kronzer |
| 6,486,903 | B1 | 11/2002 | Wagner et al. |
| 6,495,241 | B2 | 12/2002 | Sato et al. |
| 6,497,781 | B1 | 12/2002 | Dalvey et al. |
| 6,506,445 | B2 | 1/2003 | Popat et al. |
| 6,531,208 | B2 | 3/2003 | Chung |
| 6,551,692 | B1 | 4/2003 | Dalvey et al. |
| 6,667,093 | B2 | 12/2003 | Yuan et al. |
| 6,753,050 | B1 | 6/2004 | Dalvey et al. |
| 6,824,839 | B1 | 11/2004 | Popat et al. |
| 6,849,312 | B1 * | 2/2005 | Williams ..... B44C 1/1729 156/230 |
| 6,869,910 | B2 | 3/2005 | Williams et al. |
| 7,001,649 | B2 | 2/2006 | Wagner et al. |
| 7,081,324 | B1 | 7/2006 | Hare et al. |

(Continued)

FOREIGN PATENT DOCUMENTS

JP 2005096174 A 4/2005

OTHER PUBLICATIONS

Lamminmaki, et al., "The role of binder type in determining injet print Quality" Nordic Pulp and Paper Research Journal 25(30); 2010, pp. 380-390.

*Primary Examiner* — Joshua D Zimmerman
(74) *Attorney, Agent, or Firm* — Timothy J. Monahan; Monahan & Company, LLC

(57) ABSTRACT

A method of transferring an image to an article is provided using a heat-transfer assembly having a support layer and an image transfer layer, wherein the image transfer layer contains a binder, ink receptor and a film-forming, hydrophilic blocking agent. When an aqueous ink composition is used to print an image on the upper surface of the transfer assembly, the blocking agent is disrupted in the imaged areas, but not the unimaged areas, such that when the image is transferred to a substrate by the application of heat and pressure, substantially all of the binder in the unimaged areas remains with the transfer assembly.

20 Claims, 3 Drawing Sheets

(56) References Cited

U.S. PATENT DOCUMENTS

| | | | |
|---|---|---|---|
| 7,470,343 | B2 | 12/2008 | Kronzer |
| 8,157,370 | B2 | 4/2012 | Irita |
| 8,172,974 | B2 | 5/2012 | Kronzer |
| 8,337,007 | B2 | 12/2012 | Wang et al. |
| 8,350,880 | B2 | 1/2013 | Dinescu et al. |
| 8,507,055 | B2 | 8/2013 | Katampe |
| 8,826,902 | B2 | 9/2014 | Schwendimann et al. |
| 2010/0043152 | A1 | 2/2010 | Terao et al. |

* cited by examiner

METHOD OF SELECTIVELY TRANSFERRING AN IMAGE AND HEAT-TRANSFER ASSEMBLY

The present invention relates generally to heat-transfer imaging systems, and in particular to a system and method whereby only the portions of the binder that are underneath a printed image are transferred to an article.

BACKGROUND OF THE INVENTION

Heat-transfer printing is commonly used to print an image on an article, such as a textile fabric. For example, a transfer sheet having a backing layer and an image transfer layer is printed with an image. The transfer sheet is brought in contact with the article to be printed, and heat and pressure are applied to the backing layer, causing the binder present in the image transfer layer to release from the backing layer and flow to the article, along with the printed image.

Typically, only a portion of the image transfer layer is printed with an image, and the remainder of the image transfer layer is blank. Nevertheless, heat and pressure applied to the backing layer causes the entire image transfer layer to flow and bind to the article. Consequently, the image printed on the article is surrounded by a field of binder, corresponding to the overall dimensions of the transfer sheet.

Various methods and transfer sheet assemblies have been proposed to limit transfer of the unimaged areas of a transfer sheet, when printing an image on an article DeBoer et al. —U.S. Pat. No. 6,050,193 disclose printing an image on a water-soluble image receiving layer, curing the printed regions to form an oleophilic image and removing the non-imaged areas. The resulting imaging member can be used for lithographic printing.

Wagner et al. —U.S. Pat. No. 6,486,903 B1 disclose a media having a radiation curable coating thereon, which is printed with ink, and then exposed to radiation. The coating in the non-imaged areas is cured and becomes permanently bonded to the base sheet. The coating beneath the imaged areas is not polymerized and is transferred to an article by the application of heat.

Su—U.S. Pat. No. 6,124,417, Popat et al. —U.S. Pat. No. 6,080,261, U.S. Pat. No. 6,506,445 B2 and U.S. Pat. No. 6,824,839 B1 disclose a method of cold-transferring images. The image transfer sheet contains a water-activatable pressure sensitive adhesive layer and a water permeable detack layer on top of the adhesive layer. The transfer sheet is printed with a water-based ink composition, which activates the adhesive, that is, the adhesive layer becomes tacky where the ink composition has been applied. While in a tacky state, the imaged areas of the adhesive layer may be adhered to or bonded to a substrate.

Dinescu et al. —U.S. Pat. No. 8,350,880 B2 discloses a heat-transfer imaging system having an ink-receptive coating with a relatively high melting temperature. The activating ink contains a plasticizer, which lowers the melting temperature of the ink-receptive coating in the imaged areas. Only the imaged areas of the transfer sheet become adhesive under heat-transfer conditions.

Cross-linking agents may be provided in an image transfer sheet, as disclosed in Smith—U.S. Pat. No. 3,907,974. Reactive monomers, pre-polymers and/or cross-linking agents may be provided in the same or different layers of a transfer sheet. One or more of the reactive components may be blocked, rendering the composition unreactive, until such time has heat is applied to the transfer sheet. Examples of blocked isocyanate groups in image transfer sheets may be found in Devries et al. —U.S. Pat. No. 4,058,644 and Wagner et al. —U.S. Pat. No. 7,001,649 B2.

Despite the foregoing developments, shortcomings remain. Many of the technologies are limited to specific combinations of ink and binder, for example, a water-soluble image receiving layer and an ink composition capable of being cured to an oleophilic film, or a relatively high melting temperature binder, which requires an ink composition containing a plasticizer to lower the heat-transfer temperature, when printing on an article. Some of the technologies are directed to water-swellable and water-soluble adhesives, which may require additional treatments to be made washfast. Other technologies add complex processing steps, such as providing a radiation curable coating and curing the coating after an image has been printed on the transfer sheet.

Thus, there remains a need for an improved method and transfer sheet for transferring an image to an article, in which only the imaged areas are transferred, and which is compatible with conventional image transfer binders and ink receptors, as well as conventional aqueous ink compositions, introduces a minimum of additional processing steps and is washfast.

SUMMARY OF THE INVENTION

A method of selectively transferring only the imaged areas of a heat-transfer assembly and a transfer assembly for use in the process are provided, which overcome the aforementioned shortcomings. The method of transferring an image to an article employs a transfer assembly having a support layer and an image transfer layer overlaying the support layer.

The support layer has a base sheet forming the lower surface of the transfer assembly and, optionally, a release coating overlaying the base sheet. Conventional structures and compositions may be employed for the support layer.

The image transfer layer overlays the support layer and incorporates a thermoplastic binder, a hydrophilic ink receptor and a blocking agent. The invention includes systems wherein the components of the image transfer layer are in separate strata. In one embodiment of the invention, the ink receptor may be dispersed in the binder, or the binder and ink receptor may be located in different strata within the image transfer layer, for example, with the ink receptor overlaying the binder. The blocking agent may be distributed throughout either the stratum containing the binder, the stratum containing the ink receptor or both strata. In another embodiment of the invention, the blocking agent may be in a separate stratum from both the binder and the ink receptor, for example, overlaying the binder and ink receptor and forming the upper surface of the transfer assembly.

By way of example, suitable binders may be characterized as having one or more of the following features: (i) not water-swellable; (ii) a water absorption of 5 weight % or less at 50% relative humidity and 23° C.; and/or (iii) hydrophobic. The binder may be comprised of waxes, thermoplastic polymers, prepolymers, and cross-linking agents.

The ink receptor is a hydrophilic composition capable of absorbing the aqueous liquid carrier component of the ink composition used to print an image on the transfer assembly. A broad range of materials may be employed in the present invention as the ink receptor component, including hydrophilic polymers, cationic polymers and salts, hygroscopic particulates and other desiccants, such as silica, flocculants and coagulants.

Compositions suitable for the blocking agent may be characterized as hydrophilic, capable of forming a film, and disruptable by the application of water. A function of the blocking agent is to inhibit transfer of the unimaged areas of the image transfer layer, during heat-transfer of the imaged areas to an article.

An aqueous ink composition incorporating a colorant is printed on the image transfer layer of the transfer assembly. The liquid carrier present in the ink composition penetrates the image transfer layer, causes disruption of the blocking agent and is absorbed by the ink receptor, but only in the imaged areas. A feature of the image transfer layer is that it does not become tacky, in the areas where the aqueous ink composition has been absorbed. The blocking agent is not disrupted in the unimaged areas, i.e. the areas where the ink composition has not been absorbed.

In the method of the present invention, the upper surface of the transfer assembly is contacted with an article to be printed. Heat and pressure are applied to the lower surface of the transfer assembly, e.g. base sheet. The transfer assembly is heated to a temperature that causes the image transfer layer underneath the imaged areas to soften and flow from the transfer assembly to the article. The heat-transfer temperature may vary depending on the composition of the binder and the heat stability of the article. In one embodiment of the invention, the transfer assembly is heated to a temperature of 150° F. or greater. During the heat-transfer process, the areas of the image transfer layer that lie underneath the unimaged portions of the blocking layer, that is, where the blocking layer has not been disrupted, remain with the support layer.

The transfer assembly and the article are then separated, whereby the colorant provided in the aqueous ink composition is affixed to the article by the binder present in the image transfer layer. The image is washfast, without the need for further processing steps or the application of additional compositions.

DETAILED DESCRIPTION OF THE INVENTION

Without limiting the scope of the invention, the preferred embodiments and features are hereinafter set forth. Unless otherwise indicated, conditions are 25° C., 1 atmosphere of pressure and 50% relative humidity, concentrations are by weight, molecular weight is based on weight average molecular weight, and aliphatic hydrocarbons and radicals thereof are from one to twelve carbon atoms in length. The term "polymer" as used in the present application denotes a material having a weight average molecular weight ($M_w$) of at least 5,000. The term "copolymer" is used in its broad sense to include polymers containing two or more different monomer units, such as terpolymers, and unless otherwise indicated, includes random, block, statistical copolymers.

All of the United States patents and published applications cited herein are incorporated by reference.

Figure 1:
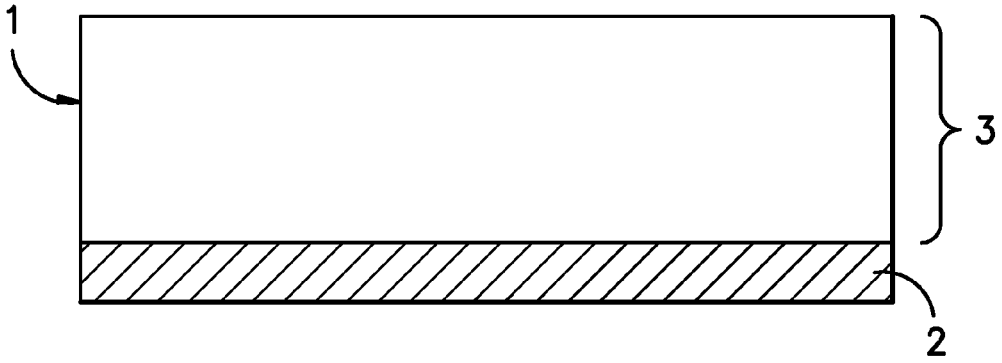
FIG. 1 is a side view of the transfer assembly of the present invention.

Referring to FIG. 1, transfer assembly 1 has support layer 2 and image transfer layer 3. Image transfer layer 3 contains a binder, an ink receptor and a blocking agent.

Figure 2:
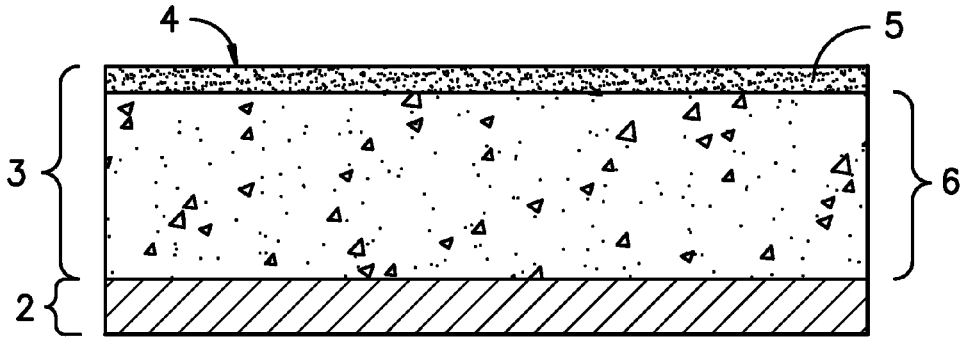
FIG. 2 is a side view of an embodiment of the transfer assembly wherein the blocking agent provided in a separate stratum overlaying a stratum containing the binder and the ink receptor.

FIG. 2 shows an alternative embodiment of the invention. Transfer assembly 4 is provided with image transfer layer 3 divided into separate stratum. The blocking agent is located in stratum 5, forming the upper surface of transfer assembly 4, and the binder and ink receptor are located in stratum 6. The binder and ink receptor may be miscible when blended together, that is, present in a single phase. Compatibilizing agents may be employed to stabilize the blend. Typically, however, the binder and ink receptor are immiscible, that is, present in two phases, which is intended to include embodiments of the invention wherein the ink receptor comprises a particulate. Also intended to be included within the term "immiscible" are embodiments of the invention wherein the ink receptor is comprised of two or more components and at least some of the components of the ink receptor are immiscible with the binder.

In one embodiment of the invention, the binder and the ink receptor are immiscible, with the binder forming a continuous phase and the ink receptor forming a discrete phase. For example, the ink receptor comprises a hygroscopic particulate, such as silica, which forms a discrete phase dispersed in a binder matrix. The silica may be provided as silica complexed with a hydrophilic polymer, such as poly(vinylpyrrolidone) or poly(vinyl)poly(pyrollidone).

Figure 3:
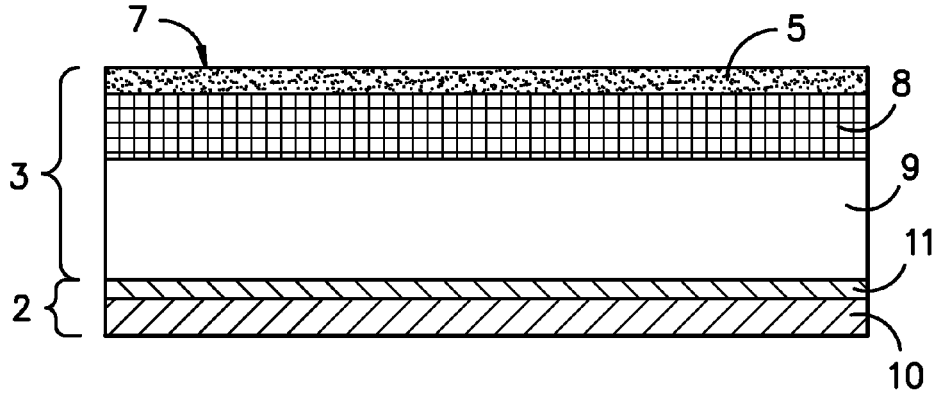
FIG. 3 is a side view of an embodiment of the transfer assembly wherein the blocking agent provided in a separate stratum overlaying the binder and the ink receptor, which are provided in separate strata of the image transfer layer.

FIG. 3 shows an alternative embodiment of the invention. Transfer assembly 7 has support layer 2 and image transfer layer 3, with the blocking agent located in stratum 5 on the upper surface of transfer assembly 7. Ink receptor 8 and binder 9 are located in separate stratum of image transfer layer 3. Ink receptor 8 is positioned overlaying binder 9, adjacent to the blocking agent in stratum 5. Support layer 2 of transfer assembly 7 is comprised of base sheet 10 having release coating 11.

It can be understood that the image transfer layer may be subdivided into additional strata, in keeping with the objectives of the present invention, and that the components (binder, ink receptor and blocking agent) may be present in two or more strata. For example, the binder may be provided in two separate strata. In one embodiment, the binder comprises a wax layer adjacent the support layer, to facilitate release of the image transfer layer.

Figure 4:
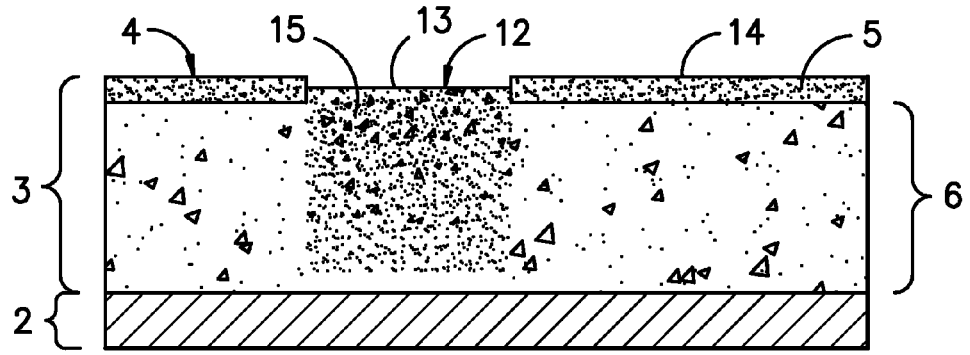
FIG. 4 is a side view of the transfer assembly of FIG. 2 showing an imaged area, after an ink composition has been applied.

Referring to FIG. 4, the transfer assembly shown in FIG. 2 is printed with an aqueous ink composition in imaged area 12. The blocking agent present in stratum 5 has been disrupted by the aqueous ink composition, as illustrated by the discontinuity in stratum 5 at section 13—the imaged area. The unimaged areas of stratum 5 containing the blocking agent have not been disrupted and are illustrated by continuous section 14. The aqueous ink composition is drawn into image transfer stratum 6 by the ink receptor located therein. It can be understood that colorant 15 will penetrate into image transfer layer 3 at varying depths, depending upon the particulars of the ink composition and image transfer layer, for example, the type of colorant, liquid carrier, relative concentration of components, binder composition, ink receptor composition, blocking agent, etc.

Support Layer

Compositions suitable for support layer 2 of a heat-transfer assembly for printing images on an article are well known in the art. The substrate layer is a material capable of providing support for the image transfer layer and the other layers of the transfer assembly, maintaining structural stability during the heat-transfer process, especially when heat is applied directly to the substrate layer, and withstanding separation from those portions of the image transfer layer that have bonded to the article being printed.

The support layer includes a base sheet, which forms the lower surface of the transfer assembly. The base sheet may be selected from (i) nonwoven webs, including those made from cellulosic fibers, such as coated and uncoated paper, parchment paper, and paper board, and those made from synthetic polymers, such as polyethylene, polypropylene, polystyrene and other polyolefins; (ii) synthetic polymers sheets, including thermoplastic polymers, such as polyester (e.g. PET and PEN), poly(vinyl chloride), polystyrene, polymethacrylate, polycarbonate, polyimide, polyurethanes, ethylene-vinyl acetate, and polytetrafluoroethylene, and thermosetting resins; (iii) metalized films, including metalized biaxially-oriented polyethylene terephthalate; (iv) woven and knitted textile sheets made of natural or synthetic fibers and combinations thereof; and (v) laminates of two or more materials from the foregoing categories, including a laminate of a nonwoven webs and a thermoplastic polymer. The base sheet may be opaque, translucent, or transparent.

The thickness of the base sheet may be in the range of about 1 mil to about 10 mil, in particular, from 2 mil to about 6 mil. By way of example, the substrate layer is designed to withstand a heat-transfer temperature of 325° F., 450° F. or even 480° F.

Base sheet 10 may optionally be provided with release coating 11, to facilitate transfer of the imaged areas of the image transfer layer to the article being printed, under the conditions described herein, as illustrated in FIG. 3. Additionally, the release coating facilitates portions of the image transfer layer underneath the unimaged areas of the transfer assembly remaining attached to the support layer, during the heat-transfer step. The release coating may be applied directly to the base sheet, between the base sheet and the image transfer layer.

The release coating may be selected from waxes, including natural or synthetic waxes, which may be crystalline, non-crystalline or semi-crystalline; thermoplastic resin oligomers; thermoplastic polymers, including acrylics and polyurethanes; thermosetting polymers; fatty acids and fatty acid esters; fluorosurfactants, including fluoro and perfluoro phosphate esters; elastomers; and silicones. Various additives may be provided in the release coating, such as surfactants, fillers and rheology modifiers.

Examples of support layers useful in the present invention may be found in the following references: U.S. Pat. No. 4,508,644; U.S. Pat. No. 6,824,839 B1; U.S. Pat. No. 7,081,324 B1; U.S. Pat. No. 8,172,974 B2; U.S. Pat. No. 8,350,880 B2; and U.S. Pat. No. 8,507,055 B2.

Image Transfer Layer

Image transfer layer 3 includes the binder, ink receptor and blocking agent. The components may be mixed together and located in the same stratum, or one or more of the components may be provided in a separate stratum, with the proviso that the if the binder is located in a separate stratum, it does not constitute the upper surface of the transfer assembly.

The binder component of the image transfer layer is thermoplastic, that is, the binder is solid and does not flow at ambient conditions, whereas the binder softens, becomes plastic and flows when heated. When an image is transferred from the transfer assembly to an article, the binder functions to adhere the colorants forming the image to the article. In one embodiment of the invention, the article receiving the image is a textile, and the image is washfast after the heat-transfer step of the process, without further treatment steps being required. Washfastness can be evaluated using the Wash Durability and Color Fastness test set forth in the examples herein.

The binder may be a wax, thermoplastic polymer, or prepolymer, or combinations thereof. Additional reactive compounds may be employed in the binder composition, including cross-linking agents, monomers and oligomers, which are capable of combining with themselves or other components in the binder composition. Constituents of the binder composition may be self-crosslinking or capable of bonding to functional groups present in the article being printed, to improve washfastness. In one embodiment of the invention, the reactive groups of the cross-linking agents or self-crosslinking polymers are "blocked" and cross-linking does not occur until the binder is heated during the heat-transfer step. For example, a cross-linking agent having one or more blocked isocyanate groups may react with an article containing hydroxyl functional groups, such as cotton fibers, during the heat-transfer step. Catalysts selected to increase the rate of the cross linking reaction may be included in image transfer layer. Examples of the cross-linking compositions may be found in U.S. Pat. No. 3,907,974; U.S. Pat. No. 4,058,644; and U.S. Pat. No. 6,103,041.

The binder can be formulated to provide greater washfastness to an image printed on an article, by selecting components characterized as having one or more of the following features: (i) not water-swellable; (ii) a water absorption of 5 weight % or less at 50% relative humidity and 23° C.; and/or (iii) hydrophobic. Binders characterized by one or more of the foregoing features are particularly useful in embodiments of the invention in which the image layer is preferably non-tacky after being printed with an ink composition and prior to being heated above ambient temperatures. In various embodiment of the invention, 50% by weight of more of the components of the binder, in particular 75% by weight or more of the components of the binder, meet one or more of the foregoing criteria.

By way of reference, the term "non-tacky" means that the image transfer layer lacks sufficient adhesive strength to cold transfer to an article, i.e. at a temperature below 150° F., after the aqueous carrier in the ink composition has been absorbed into the image transfer layer.

By way of example, suitable binders may be selected from thermoplastic polymers, including polyurethanes, polyesters, polyamides, polyolefins, poly(vinyl chloride), acrylic polymers that do not become tacky when wetted with water, and oligomers of thermoplastic polymers; and waxes, including natural and synthetic, non-crystalline, semi-crystalline and crystalline waxes. With reference to the binder, the term "thermoplastic polymers" is intended to include thermoplastic elastomers.

By way of example, the binder component of the image transfer layer may contain, by weight, from 20 to 75% thermoplastic polymer, from 10 to 90% wax, and up to 50% cross-linking agent.

The ink receptor is hydrophilic and is capable of absorbing the aqueous liquid carrier component of the ink composition used to print an image on the transfer assembly. In particular, the aqueous ink composition is printed on the upper surface of the transfer assembly, and the aqueous component of the ink is absorbed through into the image transfer layer. As the aqueous liquid carrier is drawn through the image transfer layer, the blocking agent is disrupted.

Depending on the nature of the ink composition, the colorants present in the ink composition may be absorbed by the ink receptor along with the liquid carrier, or the colorant will remain concentrated on the upper surface of the transfer sheet. For example, dyes that are soluble in the aqueous liquid carrier may be readily absorbed into the image transfer layer, whereas pigments, disperse dyes and macromolecular colorants are less mobile and penetrate less deeply into the image transfer.

By way of example, suitable ink receptors may be selected from hydrophilic polymers, including poly(acrylic acid), poly(vinyl imidazole), poly(2-hydroxyethyl methacrylate), poly(vinyl pyrrolidone), poly(vinyl)poly(pyrrolidone), and polyvinyl acetate, cationic polymers and their salts, such as polydiallyldimethylammonium chloride, polyacrylamides, and poly(epichlorohydrin-dimethylamine); hygroscopic inorganic salts, including calcium nitrate and sodium chloride; silica; zeolites; and other hydrophilic compounds used as flocculants, coagulants, and desiccants.

The objectives of providing an image transfer layer capable of absorbing the aqueous carrier of the ink composition, while providing a thermoplastic, non-tacky binder may be met by providing the ink receptor and binder in a ratio by weight of 1:19 to 7:13, respectively.

Blocking agents useful in the present invention may be characterized as hydrophilic, capable of forming a film, and disruptable by the application of water. The blocking agent serves a dual function—it prevents the unimaged areas of the image transfer layer from transferring to an article during heat-transfer printing, and it allows the imaged areas of the image transfer layer to transfer to the article. The imaged areas of the transfer assembly are able to transfer to the article, because the blocking layer is disrupted in the imaged areas by the application of the aqueous ink composition. In broad terms, the blocking agent is "disrupted" in areas where it is no longer capable of blocking transfer of the image transfer layer, during the process of heat-transferring an image to an article, i.e. when the binder becomes plastic and flows when heated. The blocking agent may be disrupted by becoming weakened or discontinuous, or even dissolving, when the aqueous ink composition is printed on the transfer assembly.

In one embodiment, the blocking agent forms a thin, continuous film on the upper surface of the transfer assembly. For example, the blocking layer may form a separate stratum overlaying a stratum or strata within the image transfer layer incorporating the binder and ink receptor. The blocking layer may range in thickness from 0.05 to 5 mils, in particular, from 0.5 to 3 mils.

Useful compositions for the blocking agent include water-soluble polymers selected from the group consisting of poly (vinyl alcohol), poly(ethylene glycol), poly(vinyl pyrrolidone), polyacrylic acid, polyacrylamides, N-(2-hydroxypropyl) methacrylamide, xanthan gum, pectins, dextran, carrageenan, guar gum, cellulose ethers, including hydroxypropyl methyl cellulose (HPMC), methyl cellulose (MC), hydroxyethyl cellulose (HEC), ethyl cellulose (EC), hydroxypropyl cellulose (HPC), carboxy methyl cellulose (CMC), and polyanionic cellulose (PAC), hyaluronic acid, albumin, and starch and starch derivatives.

In one embodiment of the invention, the blocking agent can be incorporated in the image layer as discrete particles, which can then be treated, for example, by heat, to create areas of continuity.

The blocking agent may be present in the image transfer layer in a concentration of 1 weight % or greater. The upper concentration of the blocking agent in the image transfer layer may be 20 weight %, in particular 10 weight %, more particularly 5 weight %.

Based on the overall composition of the image transfer layer the following composition, by weight, may be employed binder 65 to 90%, ink receptor 5 to 35%, blocking agent 2 to 20 weight %. The image transfer layer may also comprise various auxiliaries, including wetting agents, surfactants, defoamers, fillers, thickeners, compatibilizing agents, pigments and opacifiers, such as $TiO_2$, and plasticizers, UV stabilizers, and other plastic additives known to those skilled in the art, with the auxiliaries making up to 30%, in particular up to 20% by weight of the layer.

Ink Composition

The ink compositions useful in the present invention include a colorant and an aqueous liquid carrier. The invention is not limited to a particular type of colorant and includes, organic and inorganic pigments, dyes, or macromolecular coloring agents, such as poly(oxyalkylene) substituted chromophores and polymers incorporating such compounds, such as polyurethanes and polyesters. By way of further example, the colorant may be selected from sublimation dyes, disperse dyes, reactive dyes, acid dyes, and basic dyes, as well as titanium dioxide, carbon black, and calcium carbonate.

The aqueous carrier liquid may, in addition to water, incorporate minor amounts of organic co-solvents that are water miscible, such as lower alcohols, glycols and glycerin. By way of example, the organic co-solvents comprise 20 weight % or less of the liquid carrier component of the ink composition.

The present invention may be practiced with conventional, aqueous ink formulations used to print on paper or other substrates. Accordingly, the ink composition may contain additional components, as known to those skilled in the art, such as binders, humectants, surfactants and the like.

The ink composition may be printed on the upper surface of the transfer assembly by any of a variety of conventional techniques. By way of example, the ink composition may be applied by ink jet printing, screen printing, lithographic printing, stamping, gravure printing or the ink composition may be applied by manually. The formulation of the ink composition may be adjusted to be compatible with the printing method selected. The ink composition may range in consistency from a liquid to a paste.

Method of Use

Figure 5:
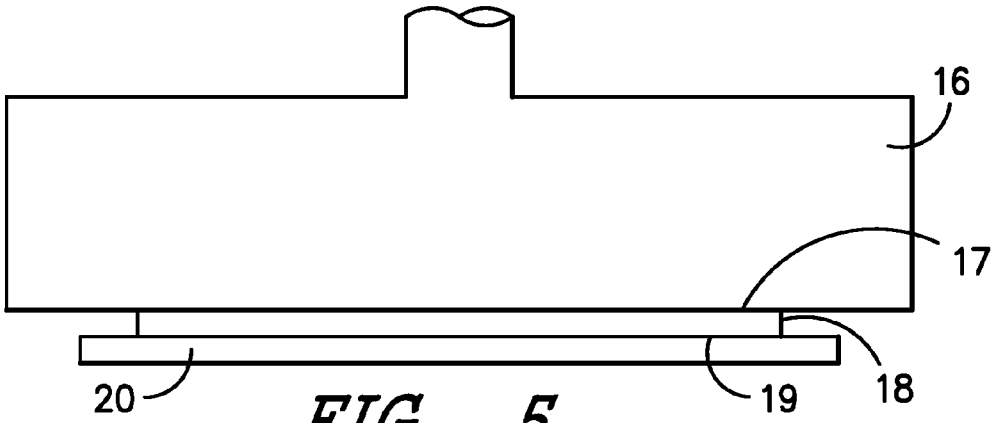
FIG. 5 is a side view of the heat-transfer process showing the transfer assembly of FIG. 4 employed to transfer an image to an article.
Figure 6:
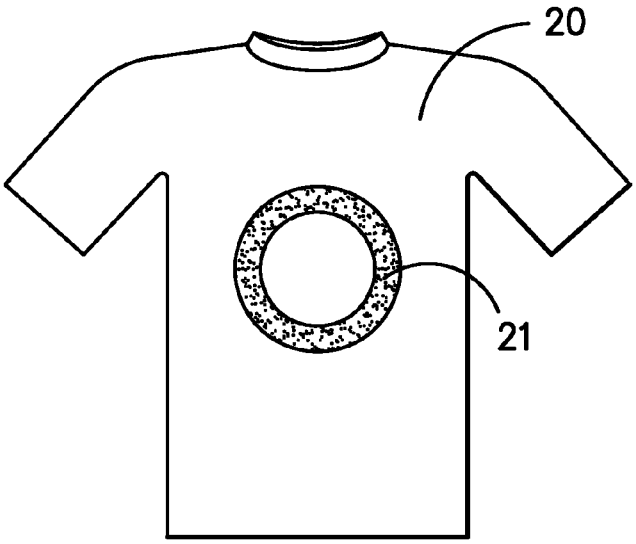
FIG. 6 is a front view of a T-shirt having only the imaged areas from the transfer assembly printed thereon.
Figure 7:
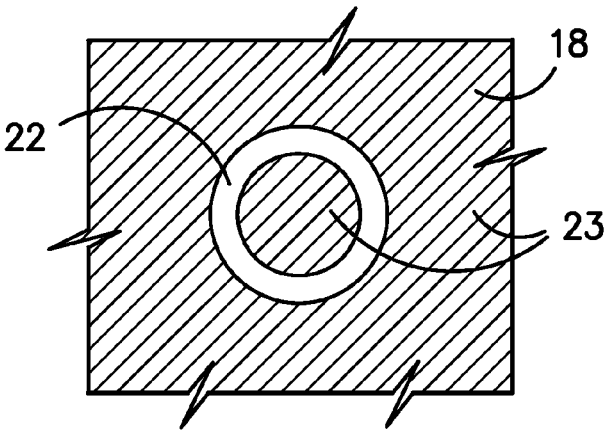
FIG. 7 is a top view of the transfer assembly showing the imaged areas having been transferred and the unimaged areas of the image transfer layer remaining.

Referring to FIGS. 5, 6 and 7, the method of using the transfer assembly of the present invention to transfer an image to an article is described. FIG. 5 shows press 16 in contact with the lower surface 17 of transfer assembly 18. The upper surface 19 of transfer assembly 18 is in contact with article 20, which is a T-shirt.

The operating conditions for press 16 may vary depending on the precise composition of the image transfer layer, the type of colorant in the ink formulation and the composition of the article being printed. The heat transfer temperature, that is, the temperature at which the imaged areas of the image transfer layer are transferred to the article, is 150° F. or greater. Improved washfastness and performance can be achieved by formulating the image transfer layer, such that the imaged areas will transfer at a temperature of from 225° F. to 475° F., in particular from 325° F. to 450° F., without transferring the unimaged areas of the image transfer layer.

A minimum pressure is applied by the press to the transfer assembly to maintain contact between the upper surface of the transfer assembly and the article being imaged. With regard to articles that are porous, such as a textile, the pressure may be selected to increase penetration of the binder into interstices in the article. The pressure should not cause disruption of the unimaged areas of the transfer assembly, in particular, not cause the unimaged areas to transfer to the article. By way of example, the pressure may range from 1 to 60 lbs. per $in^2$ (psi), in particular from 20 to 40 psi.

Typically, the time to transfer the image to an article is 5 to 90 seconds, in particular from 10 to 60 seconds. While the foregoing times have been found to be adequate for many articles, for example textiles, longer transfer times may be required for materials having a specific gravity of 2 or greater, such as glass, ceramics and metals. For example, transfer times of up to 5 or even 10 minutes may be required to allow adequate heating of the transfer assembly and the article to achieve transfer of the imaged areas. Furthermore, ink compositions incorporating certain colorants, such as sublimation dyes, may require greater transfer times.

At the end of the transfer time, the transfer assembly is peeled away from the article, with the imaged areas of the image transfer layer remaining bound to the article and the unimaged areas of the image transfer layer remaining bound to the support layer of the transfer assembly. It can be understood that the objectives of the invention may be met, even if minor amounts of the image transfer layer in the unimaged areas are transferred to the article, along with the imaged areas. In other words, depending upon the composition of the image transfer layer, the ink and the article, if the unimaged areas are at least partially blocked from transferring to the article, the overall appearance and performance of the imaged article can be improved. By way of example, the method of the present invention includes applications wherein 50 weight % or less of the unimaged areas of the transfer assembly is transferred to the article, during the transfer process. In other embodiments of the invention, 40 weight % or less, in particular, 25 weight % or less, or even 15 weight % or less of the unimaged areas of the transfer assembly is transferred to the article during the transfer process.

Referring to FIG. 6, the imaged area of the image transfer assembly in the shape of ring 21 is bound to article 20. FIG. 7 shows transfer assembly 18 with void 22 where the imaged area was located and unimaged area 23, remaining with transfer assembly 18.

Articles Useful as Substrates for Printing

The method and transfer assembly of the present invention may be used to print an image on a wide variety of articles. The article may be a woven, knitted or non-woven textile material consisting of natural or synthetic fibers, or combinations thereof. By way of example, the textile may comprise fibers selected from cotton, wool, jute, hemp, polyester, polyamide, polyurethane and polyolefin. Of particular interest are textile articles made of 100% cotton and cotton/polyester blends.

The article useful as a substrate for printing may be in the form of a film, sheet or shaped article. No particular limitation on the type of material comprising the article is necessary to successfully practice the invention. Further examples of materials that can be printed with an image according to the present invention, include glass, metals, leather, porous substrates, such as wood, paper and other cellulosic material, and synthetic polymers, which may be thermoplastic, thermosetting or elastomeric. Suitable articles also include combinations of the foregoing materials, such as laminates, including polymer coated metal and glass. Of particular interest are applications for signs, such as coated and uncoated metal signs and signs made of poly(vinyl chloride) sheets.

EXAMPLES

The following examples illustrate various combinations of the binder, ink receptor and blocking agent in the strata comprising the image transfer layer of a transfer assembly. In particular, the image transfer layer of the transfer assembly can have these components in a variety of combinations, including all in separate layers, two components combined in one layer with the third component in a separate layer, and all three components combined in a single layer.

The binder components in these examples include a blocked aliphatic polyisocyanate (Imprafix 2794 XP from Bayer), an aliphatic polyester polyurethane (Bondthane UD 125 from Bond Polymers), a sulfonated polyester (Eastek 1000 from Eastman), an elastomeric acrylic terpolymer (Hystretch V-29 from Lubrizol), a polyamide wax (Michem Wax 439 from Michelman), and a polyethylene wax (Michem Wax 437 from Michelman).

The ink receptor components include a polyvinylpolypyrrolidone (Divergan RS from Merck) and micronized silica (Sipernat 310 from Evonik).

The blocking agent components include partially hydrolyzed (87-89%) polyvinyl alcohol (Elvanol 51-05 from Kuraray) and modified corn starch (Sealmaster P30L from Grain Processing Corporation).

All of the above components were dispersed in water and applied to an uncoated polyethylene terephthalate film (standard base polyester film from Griff Paper and Film) using Mayer rods to give the desired dry coat weight of each layer. Drying of the coatings was achieved by placing the coated substrate in a convection oven at 80° F. for 5-10 minutes.

Example 1

In the following example, the image transfer layer of the transfer assembly has a binder in a first stratum, an ink receptor and binder in a second stratum overlaying the first stratum, and a blocking agent in a third stratum overlaying the second stratum. The blocking agent forms the upper surface of the transfer assembly. The composition of the three strata is given in Table 1.

The first stratum was applied using a #60 Mayer rod to give 34 gram per square meter ($g/m^2$) dry coating weight. The second stratum was applied using a #28 Mayer rod to give 18 $g/m^2$ dry coating weight. The third stratum was applied using a #10 Mayer rod to give 10 $g/m^2$ dry coating weight.

TABLE 1

Composition of the Image Transfer Layer of Example 1, with the Binder, Ink Receptor/Binder, and Blocking Agent Components in Three Separate Strata

| Functional Component | Material | Layer Loading | % Total Assembly | % Functional Component |
|---|---|---|---|---|
| | BINDER LAYER | | | |
| Binder 54.9% of Total Coating | Polyethylene wax | 63.3% | 34.8% | 54.9% |
| | Blocked aliphatic polyisocyanate | 12.0% | 6.6% | |
| | Aliphatic polyester polyurethane | 6.3% | 3.4% | |
| | Sulfonated polyester | 5.7% | 3.1% | |
| | Auxiliaries[1] | 12.7% | 7.0% | |
| | | 100.0% | 54.9% | |
| | INK RECEPTOR/BINDER | | | |
| Ink Receptor/ Binder 29.0% of Total Coating | Polyethylene wax dispersion | 92.2% | 26.8% | 29.0% |
| | Polyvinylpoly-pyrrolidone | 2.8% | 0.8% | |
| | Micronized silica | 2.8% | 0.8% | |
| | Auxiliaries[2] | 2.2% | 0.6% | |
| | | 100.0% | 29.0% | |
| | BLOCKING AGENT | | | |
| Blocking Agent 16.1% of Total Coating | Partially hydrolyzed polyvinyl alcohol | 49.2% | 7.9% | 16.1% |
| | Modified corn starch | 50.8% | 8.2% | |
| | | 100.0% | 16.1% | |

[1]Wetting agent, defoamer, fillers, thickener

[2]Defoamer and thickener

The transfer assembly of Example 1 was printed with an image using a Ricoh 3300 printer containing SubliJet R CMYK inks (water-based dye-sublimation inks from Sawgrass Technologies). The transfer assembly was placed on a 100% cotton Haynes Tagless T-shirt in a heat press with the imaged side of the assembly in contact with the T-shirt. Heat (375° F.) and pressure (40 psi) were applied to the transfer assembly and T-shirt for 20 seconds, after which the transfer assembly was removed from the T-shirt while still hot. With regard to the image transfer layer, >90% of the imaged area was transferred to the T-shirt, and >80% of the non-imaged area remained on the transfer assembly, by weight.

Example 2

In the following example, the image transfer layer of the transfer assembly has a binder in a first stratum, and the ink receptor and blocking agent in a second stratum overlaying the first stratum. The blocking agent and ink receptor form the upper surface of the transfer assembly. The composition of the two strata is given in Table 2.

The binder layer was applied using a #60 Mayer rod to give 34 g/m$^2$ dry coating weight. The combined ink receptor and blocking agent was applied using a #10 Mayer rod to give 10 g/m$^2$ dry coating weight.

TABLE 2

Composition of the Image Transfer Layer of Example 2, with the Binder, and Ink Receptor/Blocking Agent Components in Two Separate Strata

| Functional Component | Material | Layer Loading | % Total Assembly | % Functional Component |
|---|---|---|---|---|
| | BINDER | | | |
| Binder Compo-nents | Blocked aliphatic polyisocyanate | 12.2% | 9.4% | 77.3% |
| | Aliphatic polyester polyurethane | 6.4% | 4.9% | |
| | Sulfonated polyester | 5.8% | 4.5% | |
| | Polyethylene wax | 64.1% | 49.6% | |
| | Auxiliaries[3] | 11.5% | 8.9% | |
| | | 100.0% | 77.3% | |
| | INK MANAGEMENT AND BLOCKING AGENT | | | |
| Ink Receptor | Polyvinylpoly-pyrrolidone | 4.7% | 1.0% | 2.1% |
| | Micronized silica | 4.7% | 1.0% | |
| Blocking Agent | Polyvinyl alcohol | 44.5% | 10.1% | 20.6% |
| | Modified corn starch | 46.1% | 10.6% | |
| | Total | 100.0% | 22.7% | 22.7% |

[3]Wetting agent, defoamer, fillers, thickener

The transfer assembly of Example 2 was printed with an image using a Ricoh 3300 printer containing SubliJet R CMYK inks (water-based dye-sublimation inks from Sawgrass Technologies). The transfer assembly was placed on a 100% cotton Haynes Tagless T-shirt in a heat press with the imaged side of the assembly in contact with the T-shirt. Heat (375° F.) and pressure (40 psi) were applied to the transfer assembly and T-shirt for 20 seconds, after which the transfer assembly was removed from the T-shirt while still hot. With regard to the image transfer layer, >98% of the imaged area was transferred to the T-shirt, and >98% of the non-imaged area remained on the transfer assembly, by weight.

Example 3

In the following example, the image transfer layer of the transfer assembly has a binder and ink receptor in a first stratum, and the blocking agent in a second stratum overlaying the first stratum. The blocking agent forms the upper surface of the transfer assembly. The composition of the two strata is given in Table 3.

The binder layer and ink receptor combination was applied using a #60 Mayer rod to give 34 g/m$^2$ dry coating weight. The blocking agent was applied using a #10 Mayer rod to give 10 g/m$^2$ dry coating weight.

TABLE 3

Composition of the Image Transfer Layer of Example 3, with the Binder/Ink Receptor and the Blocking Agent Components in Two Separate Strata

| Functional Component | Material | Layer Loading | % Total Assembly | % Functional Component |
|---|---|---|---|---|
| | BINDER AND INK RECEPTOR | | | |
| Binder Compo-nents | Blocked aliphatic polyisocyanate | 11.8% | 9.2% | 66.2% |
| | Aliphatic polyester polyurethane | 6.2% | 4.8% | |

TABLE 3-continued

Composition of the Image Transfer Layer of Example 3, with the Binder/Ink Receptor and the Blocking Agent Components in Two Separate Strata

| Functional Component | Material | Layer Loading | % Total Assembly | % Functional Component |
|---|---|---|---|---|
| | Sulfonated polyester | 5.6% | 4.3% | |
| | Polyethylene wax | 62.0% | 47.9% | |
| Ink Receptor | Polyvinylpolypyrrolidone | 3.1% | 2.4% | 4.8% |
| | Micronized silica | 3.1% | 2.4% | |
| Other | Auxiliaries[4] | 8.2% | 6.3% | 6.3% |
| | Total | 100.0% | 77.3% | 77.3% |
| BLOCKING AGENT | | | | |
| Blocking Agent | Polyvinyl alcohol | 49.2% | 11.2% | 22.7% |
| | Modified corn starch | 50.8% | 11.5% | |
| | Total | 100.0% | 22.7% | |

[4]Wetting agent, defoamer, thickener

The transfer assembly of Example 3 was printed with an image using a Ricoh 3300 printer containing SubliJet R CMYK inks (water-based dye-sublimation inks from Sawgrass Technologies). The transfer assembly was placed on a 100% cotton Haynes Tagless T-shirt in a heat press with the imaged side of the assembly in contact with the T-shirt. Heat (375° F.) and pressure (40 psi) were applied to the transfer assembly and T-shirt for 20 seconds, after which the transfer assembly was removed from the T-shirt while still hot. With regard to the image transfer layer, >98% of the imaged area was transferred to the T-shirt, and >98% of the non-imaged area remained on the transfer assembly, by weight.

Example 4

In the following example, the image transfer layer of the transfer assembly has a binder, ink receptor and the blocking agent in a single stratum overlaying the substrate layer. The combination of the three components forms the upper surface of the transfer assembly. The composition of the stratum is given in Table 4.

The components of the image transfer layer were applied to an uncoated polyethylene terephthalate film (standard base polyester film from Griff Paper and Film) using a #60 Mayer rod to give a dry coat weight of 32 g/m$^2$.

TABLE 4

Composition of the Image Transfer Layer of Example 4, with the Binder/Ink Receptor/Blocking Agent Components in a Single Stratum
BINDER, INK RECEPTOR, AND BLOCKING AGENT

| Functional Component | Material | % Total Assembly | % Functional Component |
|---|---|---|---|
| Binder Components | Blocked aliphatic polyisocyanate | 9.0% | 78.3% |
| | Aliphatic polyester polyurethane | 4.9% | |
| | Sulfonated polyester | 4.5% | |
| | Elastomeric acrylic terpolymer | 6.7% | |
| | Polyethylene wax | 29.5% | |
| | Polyamide wax | 23.7% | |
| Ink Receptor Components | Polyvinylpolypyrrolidone | 5.9% | 11.8% |
| | Micronized silica | 5.9% | |
| Blocking Agent | Polyvinyl alcohol | 1.4% | 2.9% |
| | Modified corn starch | 1.5% | |
| Other | Auxiliaries[5] | 7.0% | 7.0% |
| | Total | 100.0% | 100.0% |

[5]Wetting agent, defoamer, thickener

The transfer assembly of Example 4 was printed with an image using a Ricoh 3300 printer containing SubliJet R CMYK inks (water-based dye-sublimation inks from Sawgrass Technologies), and the ink dried instantly. The transfer assembly was placed on a 100% cotton Haynes Tagless T-shirt in a heat press with the imaged side of the assembly in contact with the T-shirt. Heat (375° F.) and pressure (40 psi) were applied to the transfer assembly and T-shirt for 20 seconds, after which the transfer assembly was removed from the T-shirt while still hot. With regard to the image transfer layer, >98% of the imaged area was transferred to the T-shirt, and >98% of the non-imaged area remained on the transfer assembly, by weight.

Example 5

Three commercially produced and sold transfer heat-transfer assemblies were procured for testing, namely: Jet-Pro SofStretch from Neenah Paper, ChromaBlast (purple backing) from Sawgrass Technologies, and RedGrid from Misiland Industrial (China). The transfer assemblies include an image transfer layer comprising a binder and ink receptor. Each of these three papers was coated with a layer of blocking agent, which included partially hydrolyzed (87-89%) polyvinyl alcohol (Elvanol 51-05 from Kuraray) and modified corn starch (Sealmaster P30L from Grain Processing Corporation), at a dry weight ratio of 1:1, to provide a dry coating weight of 10 g/m$^2$. The composition of the blocking agent layer in the transfer assembly is provided in Table 5.

TABLE 5

Composition of the Blocking Agent Stratum Coated on the Upper Surface of Various Commercial Heat-Transfer Assemblies

| | | |
|---|---|---|
| Blocking Components | Polyvinyl Alcohol | 49% |
| | Modified Corn Starch | 51% |
| | Total | 100% |

Each of these three transfer assemblies coated with a blocking agent composition was printed with an image using a Ricoh 3300 printer containing SubliJet R CMYK inks (water-based dye-sublimation inks from Sawgrass Technologies). The transfer assembly was placed on a 100% cotton Hanes Tagless T-shirt in a heat press with the imaged side of the assembly in contact with the T-shirt. Heat (375° F.) and pressure (40 psi) were applied to the transfer assembly and T-shirt for 20 second, after which the transfer assembly was removed from the T-shirt while still hot. With regard to the image transfer layer, 98% of non-imaged area remained on the JetPro transfer assembly, 95% of the non-imaged area remained of the ChromaBlast transfer assembly, and 75% of the non-imaged area remained on the RedGrid transfer assembly, by weight.

Example 5 demonstrates that the blocking technology of the present invention can be applied to commercial heat-transfer assemblies to afford image transfers with high levels of blocking of the non-imaged areas.

Without the blocking agent of the present invention applied to the upper layer of the three commercial heat-transfer assemblies referenced in Example 5, 80% by weight or greater of the non-imaged areas of the image transfer layer of the heat-transfer assemblies were found to transfer to the substrate (100% cotton T-shirt), following the protocol set forth above.

Wash Durability and Color Fastness

The imaged T-shirts of Examples 1-5 were allowed to age for approximately twenty four hours and tested for wash fastness according to the following protocol. A total of five (5) T-shirts was tested for each of the examples and the average rating was reported.

Wash Conditions:

Speed Queen Washer (Alliance Laundry Systems, Model ADE4BRGS171TW01)

Water Level—Extra Large

Water Temp (Wash/Rinse)—Warm/Cold

Agitation (Level)—High (Regular-Normal Cycle)

Detergent—One (1) fluid ounce of Gain detergent (regular)

Drying Conditions:

Speed Queen Dryer (Alliance Laundry Systems, Model AWN432SP111TW01)

Fabric Selector—Permanent Press

Dry Time—15 minutes

After the washing procedure described above, the T-shirts were visually inspected to determine Image Quality (pass/fail). A grade of "Fail" is given to any T-shirt if one or more of the following were observed: binder in the imaged area was cracked or peeled, or color in the imaged area was discontinuous.

TABLE 6

| Wash Fastness | Imaged T-shirt |
|---|---|
| Pass | Example 1 |
| Pass | Example 2 |
| Pass | Example 3 |
| Pass | Example 4 |
| Pass | Example 5[6] |

[6]All three of the modified commercial products of Example 5 were tested and found to pass.

There are, of course, many alternative embodiments and modifications of the invention intended to be included within the scope of the following claims.

What we claim is:

1. A method of transferring an image to an article, comprising the steps of:

(a) providing a transfer assembly having a lower surface and an upper surface, comprising (i) a support layer having a base sheet, and the base sheet forms the lower surface of the transfer assembly; (ii) an image transfer layer, overlaying the support layer, the image transfer layer comprising a thermoplastic binder, a hydrophilic ink receptor and a blocking agent, wherein the blocking agent is a hydrophilic, film-forming composition, which is disruptable by the application of water, wherein the image transfer layer forms the upper surface of the transfer assembly;

(b) printing an ink composition on portions of the upper surface of the transfer assembly thereby defining imaged areas and unimaged areas, the ink composition comprising a colorant and an aqueous, liquid carrier, whereby the blocking agent is disrupted by the liquid carrier in the imaged areas, and whereby the liquid carrier is absorbed by the ink receptor and the upper surface of the transfer assembly is not tacky;

(c) contacting the upper surface of the transfer assembly with the article to be printed;

(d) applying heat and pressure to the lower surface of the transfer assembly, whereby the transfer assembly is heated to a temperature of 150° F. or greater and the binder in the image transfer layer in the imaged areas is caused to flow from the transfer sheet to the article, and whereby 50 weight % or less of the image transfer layer in the unimaged areas is transferred to the article; and (e) separating the support layer of the transfer assembly from the article, whereby the colorant present in the ink composition is affixed to the article by the binder in the imaged areas.

2. The method of claim 1, wherein the transfer assembly is heated to a temperature of from 225° F. to 475° F. while in contact with the article.

3. The method of claim 2, wherein the image transfer layer comprises first and second strata, and the blocking agent is in a first stratum forming the upper surface of the transfer assembly.

4. The method of claim 3, wherein the first stratum further comprise the ink receptor, and the second stratum comprises the binder, whereby the first stratum overlays the second stratum.

5. The method of claim 3, wherein the second stratum comprises the ink receptor, and the image transfer layer further comprising a third stratum comprising the binder.

6. The method of claim 2, wherein the binder and ink receptor are mixed together in the image transfer layer and form a two-phase system, with the binder forming a continuous phase and the ink receptor forming a discrete phase.

7. The method of claim 6, wherein the ink receptor comprises a hygroscopic particle.

8. The method of claim 2, wherein the ink receptor comprises silica particles.

9. The method of claim 1, wherein the ink receptor comprises a polyvinylpolypyrrolidone and silica complex, or a poly(vinyl) poly(pyrrolidone) and silica complex.

10. The method of claim 1, wherein the transfer assembly is heated to a temperature of from 325° F. to 450° F. while in contact with the article.

11. The method of claim 1, whereby 25 weight % or less of the image transfer layer in the unimaged areas is transferred to the article.

12. The method of claim 1, whereby 15 weight % or less of the image transfer layer in the unimaged areas is transferred to the article.

13. The method of claim 1, wherein the blocking agent is selected from the group consisting of poly(vinyl alcohol), poly(ethylene glycol), poly(vinyl pyrrolidone), polyacrylic acid, polyacrylamides, N-(2-hydroxypropyl) methacrylamide, xanthan gum, pectins, dextran, carrageenan, guar gum, cellulose ethers, hyaluronic acid, albumin, and starch and starch derivatives.

14. The method of claim 13, wherein the binder is selected from the group consisting of compounds that (i) are not water-swellable, (ii) have a water absorption of 5 weight % or less at 50% relative humidity and 23° C., and (iii) are hydrophobic.

15. The method of claim 13, wherein the binder is selected from polyurethanes, polyesters, polyamides, polyolefins, poly(vinyl chloride), acrylic polymers that do not become tacky when wetted with water, and waxes.

16. The method of claim 15, wherein the ink receptor is selected from the group consisting of poly(acrylic acid), poly (vinyl imidazole), poly(2-hydroxyethyl methacrylate), poly (vinyl pyrrolidone), poly(vinyl)poly(pyrrolidone), and polyvinyl acetate, cationic polymers and their salts, hygroscopic inorganic salts, silica and zeolites.

17. The method of claim 2, wherein the binder comprises a compound having blocked isocyanate functional groups and the article comprises a plurality of hydroxyl functional groups, and the isocyanate groups and hydroxyl groups react to form a urethane, when the transfer assembly is heated while in contact with the article.

18. The method of claim 2, wherein the image transfer layer comprises from 65 to 90 weight % binder, from 5 to 35 weight % ink receptor, and from 1 to 20 weight % blocking agent.

19. A transfer assembly for printing an image on an article, comprising:

(a) a support layer comprising a base sheet, and the base sheet forms the lower surface of the transfer assembly;

(b) an image transfer layer comprising a thermoplastic binder, a hydrophilic ink receptor and a hydrophilic, water-disruptable, film-forming blocking agent, overlaying the support layer and forming the upper surface of the transfer assembly; and (c) an ink composition applied to portions of the upper surface of the transfer assembly thereby defining imaged areas and unimaged areas, the ink composition comprising a colorant and an aqueous, liquid carrier, whereby the liquid carrier is absorbed by the ink receptor and the upper surface of the transfer assembly is not tacky, and whereby the blocking agent is disrupted by the liquid carrier in the imaged areas and the blocking agent is not disrupted in the unimaged, such that when the upper surface of the transfer assembly is contacted with the article to be printed and the transfer assembly is heated to a temperature of 150° F. or greater, the binder in the imaged areas of the image transfer layer can be made to flow from the transfer sheet to the article, while 50 weight % or less of the image transfer layer in the unimaged areas is transferred to the article and remains with the support layer.

20. The transfer assembly of claim 19, wherein the image transfer layer comprises first and second strata, and the blocking agent is in a first stratum forming the upper surface of the transfer assembly.

* * * * *